United States Patent [19]

Munter

[11] Patent Number: 5,067,924

[45] Date of Patent: Nov. 26, 1991

[54] DOLL FOR SUMULATING WEIGHT LOSS/GAIN

[76] Inventor: Beverly L. Munter, 51 Fountain La., Jericho, N.Y. 11753

[21] Appl. No.: 595,179

[22] Filed: Oct. 10, 1990

[51] Int. Cl.[5] ..... A63H 3/36; A63H 3/12; A63H 13/02

[52] U.S. Cl. ..... 446/320; 446/321; 446/296

[58] Field of Search ..... 446/295, 296, 268, 320, 446/321, 369, 370

[56] References Cited

U.S. PATENT DOCUMENTS

| | | | |
|---|---|---|---|
| 902,113 | 10/1908 | Ruple . | |
| 1,307,218 | 6/1919 | Spencer | 446/369 |
| 1,690,778 | 11/1928 | Ford | 446/369 |
| 2,154,121 | 4/1939 | Bold . | |
| 2,347,405 | 4/1944 | Ford | 446/369 |
| 2,540,701 | 2/1951 | Thorpe | 446/369 |
| 2,741,870 | 4/1956 | Lang | 446/320 |
| 3,731,426 | 5/1973 | Lewis et al. | 446/320 |
| 3,812,613 | 5/1974 | Glass et al. . | |
| 3,992,807 | 11/1976 | Sapkus et al. . | |
| 4,236,347 | 12/1980 | Fauls . | |
| 4,259,807 | 4/1981 | Silverstein . | |
| 4,575,351 | 3/1986 | Gonzalez | 446/369 X |
| 4,828,528 | 5/1989 | Chalkis | 446/320 |
| 4,917,607 | 4/1990 | Van Hoose . | |

*Primary Examiner*—Danton D. DeMille

*Attorney, Agent, or Firm*—Schechter, Brucker & Pavane

[57] ABSTRACT

The disclosure describes an apparatus and method for facilitating weight loss. In particular, a doll that will simulate weight loss and weight gain according to simultaneous weight loss and weight gain of the doll's owner is disclosed. Layers of "skin" made of stretchable synthetic material, such as vinyl, are added or removed from the doll each time the doll's owner gains or loses one weight increment, respectively. Each layer represents a particular predetermined weight increment, which may be determined by the doll's owner. The doll may be male or female, preferably includes jointed body parts, and may be dressed, such as in a running suit which fits over the layers of skin.

6 Claims, 2 Drawing Sheets

FIG. 3
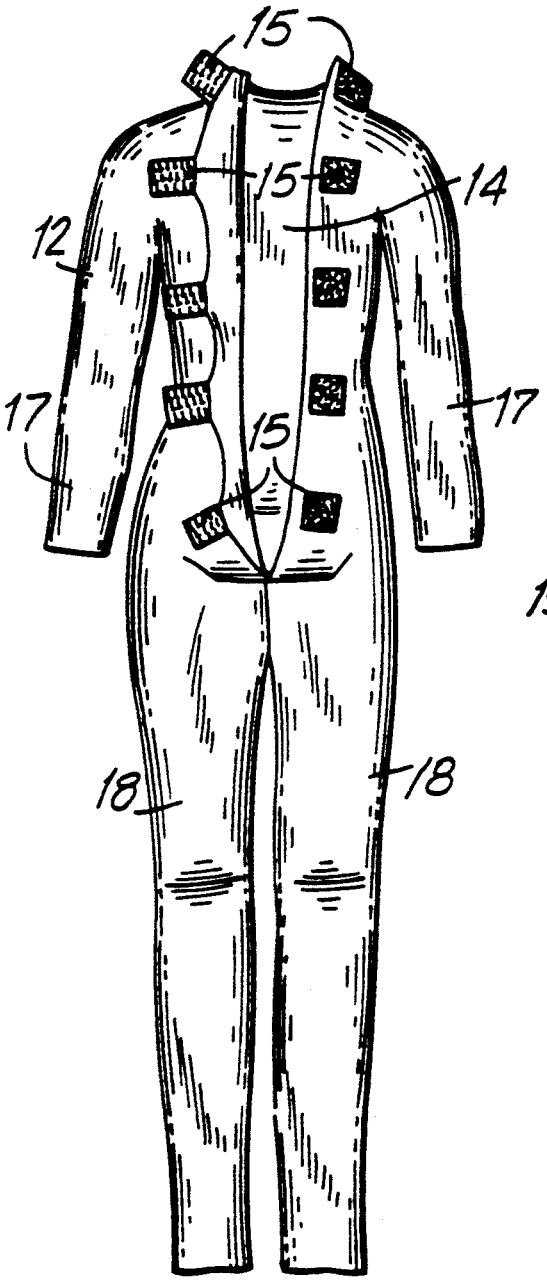
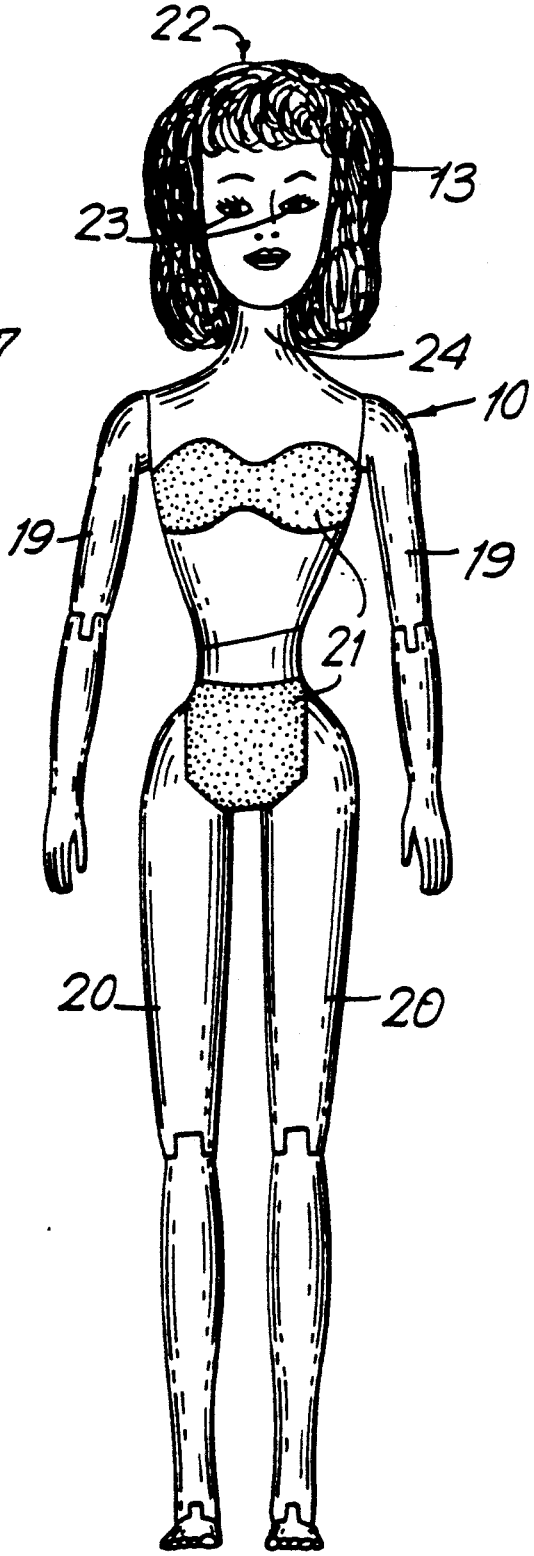
FIG. 4

DOLL FOR SUMULATING WEIGHT LOSS/GAIN

BACKGROUND OF THE INVENTION

1. Field of the Invention

The invention pertains to dolls which simulate physical changes in the human body and particularly Weight loss or weight gain.

2. Prior Art

A variety of changeable dolls are known in the prior art. Typically, such dolls are structurally complex, requiring, for example, a shell which expands by liquid means or a power supply for driving a mechanical system for changing the doll's size or shape.

U.S. Pat. No. 2,154,121 discloses a mechanical toy in the form of a human figure or doll which simulates feeding by means of a motor, crank and link connections which effect expansion or contraction of the doll's abdomen.

U.S. Pat. No. 3,812,613 disclosed a doll which simulates various stages of pregnancy. The torso of the doll is made of a substantially rigid material with an interruption in the abdomen portion covered by a yieldable skin portion. The interior of the abdomen has a screw-driven plunger, movable by a driving tool, into engagement with the yieldable skin portion to thus distend the abdomen thereby simulating pregnancy. Similarly, U.S. Pat. No. 3,992,807 is a growth-simulating figure toy which simulates the growth of a female from a preteenager to a teenager by means of expandable breasts actuated by crank shaft and lever means, and upper and lower torso members, with the upper torso member being moveable from a first position to a trimmer-looking second position.

U.S. Pat. No. 4,236,347 discloses a flexible doll having a normal form defined by a molded elastic skin for receiving a viscous liquid filler and a separate molded, rotatable head. Addition of the viscous filler stretches and deforms the doll's body parts, with the doll returning to its normal form upon removal of the filler.

U.S. Pat. Nos. 4,259,807 and 4,828,528 disclose dolls which simulate child-growth. U.S. Pat. No. 4,259,807 shows a stuffed doll having extendable arms and leg means. U.S. Pat. No. 4,828,528 discloses a doll provided with a stretchable inner liner having an expandable core within and a skin layer in intimate contact with the inner liner. The inner lining has two or more growth phase means such as stitchings which, when removed, cause the doll to grow a predetermined extent. The doll, however, cannot be returned to its original form.

U.S. Pat. No. 4,917,607 describes an apparatus and method for facilitating communication of human emotions for attitudinal healing or play. A rag-type doll having built-in cavities for receiving fabric forms representing various human feelings is used. The cavities may be secured by suitable closure means such as zippers, snaps, buttons, velcro, etc.

It is accordingly an object of the present invention to provide a changeable doll for simulating weight loss and weight gain which incorporates a minimum number of parts for facilitating assembly and reducing manufacturing costs.

It is a further object of the present invention to provide a changeable doll for simulating weight loss and weight gain which does not require a power supply means for driving mechanical or electrical systems, liquid fillers, or inflatable means.

It is a still further object of the present invention to provide a changeable doll which is easy for the owner to use and transport when he or she is at home, at work or traveling, such that the owner is easily accompanied by a "friend," a companion in the weight loss process.

SUMMARY OF THE INVENTION

The present invention is a changeable doll for simulating weight loss and weight gain of the doll's owner.

Broadly speaking, the invention comprises a doll's body and means for increasing or decreasing at least the torso size of the doll's body in predetermined increments, whereby to simulate weight gain or weight loss, respectively. A method for encouraging weight loss in an individual is also disclosed and, in the broad sense, comprises providing a doll's body of the same gender as the individual; providing the doll with means for increasing or decreasing at least the torso size of the doll's body in predetermined increments, whereby to simulate weight gain or weight loss, respectively; increasing the doll's torso size as the individual gains an increment of weight; and decreasing the doll's torso size as the individual loses an increment of weight.

In a preferred embodiment, the doll is three-dimensional, formed of molded flesh-colored plastic or an equivalent substantially rigid material, and stands about one foot high. The doll is moveable for sitting, bending or twisting by means of jointed body parts such as at the head, neck, shoulders, elbows, hips, knees and ankles. The doll's eyes may open and close. To facilitate identification with the doll's owner, the doll may be male or female, have black, blonde, brunette hair, etc.

The basic doll represents the owner's ideal size after weight loss. Swimwear suitable for the doll's gender may be painted on the doll's body.

Included with the preferred doll are a plurality of layers of skins, preferably at least five, each of which is comparable to a skin-diver's suit and made of a stretchable, light-weight, flesh-colored material, such as vinyl. The skins, being stretchable, are easy for the owner to put on and take off the doll. For this purpose, an opening is provided in the front or back of each skin so that the doll may be inserted, legs first, whereupon the legs and arms of the skin may be pulled over the doll's arms and legs, with the doll's head, neck, hands and feet left exposed. Once the skin is in place on the doll, the opening in the skin is closed, as by Velcro TM tabs or other suitable closure means. The next skin layer can then be added in a similar fashion, and so on. Clothing, such as a jogging suit, is also provided with the doll. The jogging suit is sufficiently flexible to fit over all the skin layers when in place on the doll, such that changes in the "weight" of the doll resulting from the addition or removal of skins are clearly visible when the jogging suit is worn.

In accordance with the invention, each skin represents an increment of weight, the value of each increment being determined by the owner. For example, if the owner wishes to lose 25 pounds, each layer of skin may be designated as five pounds. Each layer of skin preferably has a designated location where the owner can mark, as by stick-on tabs or marker pencil, the desired incremental weight for that layer. As will now be apparent, the owner will add or remove layers of skin to the doll as he/she gains or loses weight. Of course, each time a layer is added, the doll gets bigger, thereby simulating weight gain, while each time a layer is removed, the doll shrinks in size. In this way, the owner is provided with a constant visual reminder of his/her own weight condition which, it is believed, provides a positive psychological inducement to succeed at weight loss.

As presently contemplated, each doll will be sold and packaged separately. For example, each doll may be packaged on cardboard and be covered with blow-molded plastic for on-the-shelf viewing. An introduction and instruction booklet for the doll and skins, aerobic exercise and health tips, standardized height and weight chart, and an order form for purchase of additional skins may be included with each package. The dolls can be sold over-the-counter in department or specialty stores, or through catalogs. Additionally or alternatively, the dolls may be distributed through weight-loss programs.

Further features and advantages of the changeable doll in accordance with the present invention will be more fully apparent from the following detailed description and annexed drawings of a presently preferred embodiment thereof.

BRIEF DESCRIPTION OF THE DRAWINGS

In the Drawings

FIG. 3 is a rear elevational view of one of the removable skins provided with the doll; and FIG. 4 is a front elevational view of the doll with all skins removed.

DETAILED DESCRIPTION OF THE PREFERRED EMBODIMENT

Figure 1:
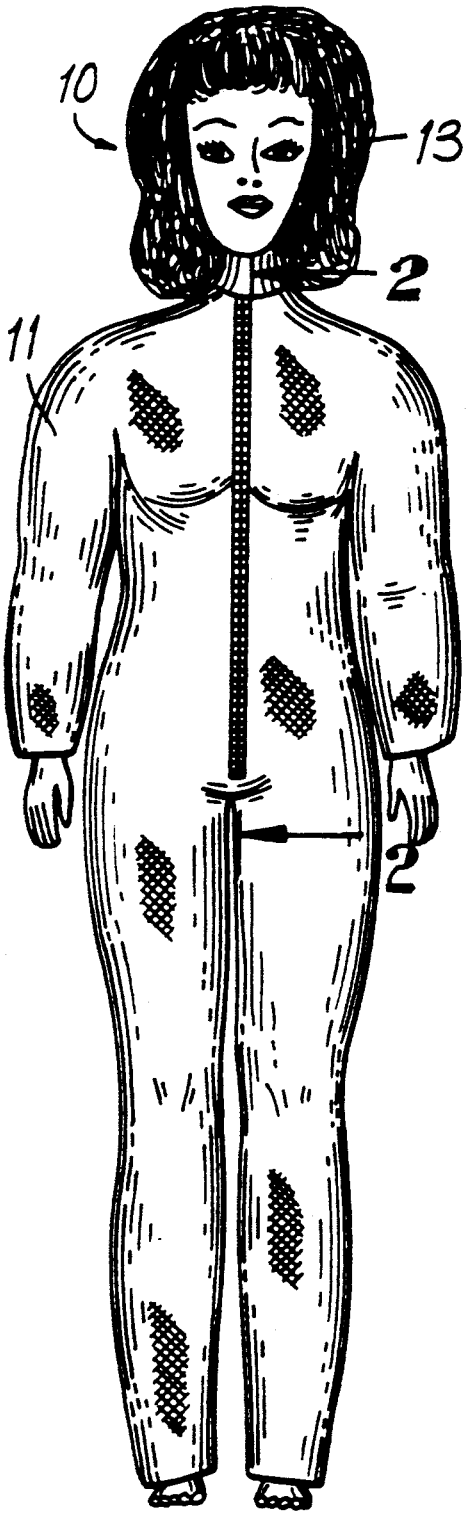
FIG. 1 is a front elevational view of a female doll dressed in a jogging suit with four skins therebeneath.
Figure 2:
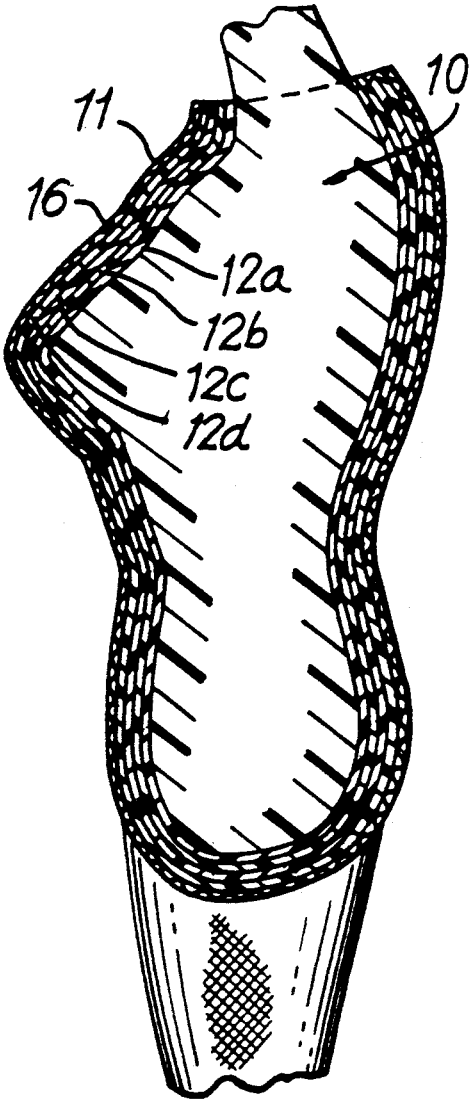
FIG. 2 is a fragmentary sectional view taken substantially along line 2—2 of FIG. 1.

Referring now to the drawings, a preferred doll in accordance with the present invention is generally designated at 10. As shown in FIG. 1, the doll 10 is dressed in a jogging suit 11 made, for example, from parachute material, though other materials may also be employed. As shown in FIG. 1, the jogging suit 11 has a front closure, which may be a hook and loop type fastener, such as Velcro TM, for facilitating dressing and undressing the jogging suit 11 from the doll 10. In FIG. 1, the doll appears heavy, as four layers of skins 12*a*–12*d* (see FIG. 2) are disposed on the doll underneath the jogging suit 11. As shown in FIG. 1, the doll's hair 13, which may be black, blonde, brunette, etc., is natural in appearance and rooted in the head of the doll.

Referring to FIG. 3, an individual layer of "skin" 12, representing a weight increment to be added or removed from the doll 10, is shown. Each skin is made of a stretchable, lightweight, flesh-colored synthetic material, such as vinyl. An opening 14 is provided in the back of each skin layer 12, such that the doll may be inserted therein, whereupon the legs 18 and arms 17 of the skin can be pulled over the doll's legs 20 and arms 19 (see FIG. 4), respectively. As best shown in FIG. 1, when the skins 12 are on the doll 10, the doll's head, neck, hands and feet remain exposed.

Once a skin 12 is in place on the doll 10, the opening 14 is closed by a closure means, such as the pairs of hook and loop fasteners 15, which may comprise Velcro TM. The next layer can then be added in a similar fashion and so on. Each layer 12 preferably has a designated area 16 for marking the "weight" of that layer. For example, each layer of skin 12 may be preprinted with a designated weight, such as "5 pounds" or "10 pounds". Alternatively, means, such as stick on patches or blank areas suitable for marking as with a marker pencil, may be provided with the doll 10 such that the owner can assign any desired weight to each skin 12. In either event, it will be appreciated that the owner will add or remove layers of skin 12 from the doll 10 simultaneously with his/her weight gain or weight loss, respectively, with the "weight" of the skins 12 added or removed corresponding to the weight added or lost by the owner.

The doll 10 is intended to encourage weight loss by having the owner identify with it physically. Thus, the doll 10 represents the owner's ideal weight when all the layers of skins 12 are removed. As shown in FIG. 4, a swimsuit 21 suitable for the doll's gender, in this case female, is painted on the molded plastic torso of the doll 10. This suggests to the owner that, after losing a desired amount of weight, he or she will appear as proportionally correct and attractive as the doll.

Assuming, for example, that the owner is 20 pounds overweight, four 5 pound skins or two 10 pound skins would be added to the doll 10, after which the suit 11 is applied. The effect, of course, is that the doll 10 appears overweight—a constant psychological reminder to the owner to lose weight. Then, as weight is lost or gained, additional layers are removed or added, respectively, with the ultimate goal that all layers are removed when the owner reaches his or her ideal weight.

As best shown in FIG. 4, to make the doll appear realistic and to provide the owner with flexibility in placing the doll, the doll 10 may preferably have a variety of moveable and jointed parts. Specifically, the head 22, which houses a pair of moveable eyes, may be jointed for movement at the neck 24. The shoulders 25, elbows 26, hips 27, knees 28 and ankles 29 also may be jointed for movement so that the doll 10 can twist, bend and sit. By means of its jointed parts, the doll could sit next to its owner at his or her desk, or on a kitchen counter or shelf. Also, because it is easily transportable, the doll 10 can accompany the owner at home, to work or when traveling.

While I have herein shown and described a preferred embodiment of a doll for simulating simultaneous weight loss or weight gain in accordance with the present invention, and have suggested certain changes and modifications thereto, it will be apparent to those of ordinary skill in the art that still further changes and modifications may be made therein without departing from the spirit and scope of the invention. Accordingly, the above description should be construed as illustrative, and not in a limiting sense, the scope of the invention being defined by the following claims.

What is claimed is:

1. A method for encouraging weight loss in an individual comprising the steps of:

providing a doll's body of the same gender as said individual;

providing said doll with a plurality of layers of simulated skin, each representing a predetermined weight increment, said simulated skins being fittable one over the other for simulating weight gain and loss as said simulated skins are added and removed, respectively;

increasing said doll's torso size as said individual gains an increment of weight by adding a predetermined number of said simulated skins onto said torso one over the other, said added skins corresponding to said weight gain; and decreasing said doll's torso size as said individual loses an increment of weight by removing a predetermined number of said simulated skins from said torso, said removed simulated skins corresponding to said weight loss.

2. The method according to claim 1, wherein said step of providing said doll's body comprises providing a swimsuit on the torso of said doll to symbolize the individual's more attractive appearance after weight loss.

3. The method according to claim 1, further comprising the step of:

providing clothing means for dressing the doll, said clothing means being adapted to be worn over the outermost simulated skin layer, so that the doll will appear heavy when one or more simulated skins are worn underneath said clothing means.

4. The method according to claim 3, wherein said step of providing a plurality of simulated skins further comprises providing each skin layer with an indicia thereon indicating the weight increment represented thereby.

5. The method according to claim 1, wherein said step of providing a plurality of simulated skins further comprises providing each simulated skin layer with an indicia thereon indicating the weight increment represented thereby.

6. A doll for simulating an individual's weight loss or weight gain comprising:

a doll's body;

a plurality of layers f simulated skin, each representing a predetermined weight increment, said simulated skin layers being fittable one over the other for simulating weight gain and loss as simulated skins are added and removed, respectively;

and wherein each simulated skin layer has an indicia thereon indicating the weight increment represented thereby.

* * * * *